United States Patent [19]

Nomura et al.

[11] Patent Number: 4,712,497

[45] Date of Patent: Dec. 15, 1987

[54] SEWING MACHINE

[75] Inventors: Etuzo Nomura; Yasuo Sakakibara; Tetsuo Kozawa; Yukio Nishida; Ikuzo Kondo, all of Nagoya, Japan

[73] Assignee: Brother Kogyo Kabushiki Kaisha, Nagoya, Japan

[21] Appl. No.: 853,486

[22] Filed: Apr. 18, 1986

[30] Foreign Application Priority Data

Apr. 25, 1985 [JP] Japan ..... 60-89280

[51] Int. Cl.[4] ..... D05B 27/22; D05B 69/22

[52] U.S. Cl. ..... 112/315; 112/277

[58] Field of Search ..... 112/275, 277, 453, 454, 112/456, 121.11, 315, 313, 314

[56] References Cited

U.S. PATENT DOCUMENTS

Re. 32,143 5/1986 Carbonato et al. ..... 112/454

4,495,877 1/1985 Willenbacher ..... 112/315

*Primary Examiner*—Peter Nerbun

*Attorney, Agent, or Firm*—Jordan and Hamburg

[57] ABSTRACT

A sewing machine forms a seam in the form of a series of stitches for a length preset by the operator. The length of the seam formed is computed from feed pitches data each generated when one stitch is formed. The operation of the sewing machine is stopped when the computed seam length coincides with the preset seam length.

4 Claims, 6 Drawing Figures

SEWING MACHINE

BACKGROUND OF THE INVENTION

The present invention relates to a sewing machine for forming a seam of a desired length based on preset data.

There is known a sewing machine of the type described as disclosed in U.S. Pat. No. 3,209,713. According to the disclosed sewing machine, the operator determines the number of stitches to be formed on the basis of a desired seam length and a feed pitch, and presets the determined number of stitches. A seam of the desired length can be formed on the sewing machine simply by starting same. More specifically, the stitches formed after the sewing operation has started are counted, and the motor of the sewing machine is deenergized when the count reaches a preset count. For sewing a label to a work fabric, for instance, the operator calculates the number of stitches based on the size of the label and a given feed pitch and presets the calculated number of stitches, followed by a trial sewing operation. If the feed pitch setting is found to be wrong as a result of the trial sewing operation, or if better sewing is desired, the operator is required to reset the feed pitch. At this time, the operator is also required to set the number of stitches so as to form a seam of the predetermined length. As a consequence, the operator must carry out the complex procedure each time a trial sewing operation is effected.

Another conventional sewing machine capable of forming a seam of a desired length such as a buttonhole seam is disclosed in U.S. Pat. No. 4,343,249. The sewing machine has a presser frame for a presser foot for pressing a work fabric against the bed of the sewing machine, the presser frame being movable with the work fabric. The distance the presser frame is moved is detected by a potentiometer. Inasmuch as the sewing machine can be stopped by a detected signal from the potentiometer, a desired seam length can be fromed irrespective of variations in the feed pitch. However, the distance in which the presser frame is movable is limited, and a seam length longer than such distance cannot be formed.

U.S. Pat. No. 3,808,995 shows a sewing machine capable of detecting the distance a work fabric is moved. The disclosed sewing machine has a differential feed means for maintaining the surplus width of the work fabric, and a pole wheel for detecting the movement of the work fabric in order to feed the work fabric for a predetermined length over which the surplus width is to be maintained. Each time the pole wheel turns for an interval corresponding to the movement of the work fabric for 1 mm, one pulse is generated by an impluse preparation stage. Such pulses are counted, and a step motor is turned through one step each time the count reaches a preset count. When a control disk is rotated for one revolution by the step motor, the operation of the sewing machine is stopped. Since the sewing machine ceases to operate when the control disk makes one rotation, it can feed a work fabric of a predetermined length even if the feed pitch is varied. However, this sewing machine is complicated in construction and the operator's action is interfered with as the pole wheel is mounted on the sewing machine bed.

SUMMARY OF THE INVENTION

In view of the aforesaid problems of the prior art sewing machines, it is a first object of the present invention to provide a sewing machine capable of forming a seam of a desired length simply by presetting the desired seam length, and of easily varying a work fabric feed pitch.

A second object of the present invention is to provide a sewing machine which can efficiently be operated by the operator and is inexpensive to manufacture.

According to the present invention, there is provided a sewing machine comprising a stitch forming device for forming a seam in the form of a series of stitches on a work fabric, the stitch forming device including a sewing needle reciprocally movable in synchronism with the rotation of a main shaft of the sewing machine, a work feeding device for intermittently feeding the work fabric in synchronism with the rotation of the main shaft, means for adjusting a feed pitch at which the work fabric is fed by the work feeding device, feed pitch data generating means for detecting the feed pitch as adjusted by the adjusting means to generate feed pitch data, means for setting a preset seam length, means for computing a seam length produced by each stitch from the feed pitch data, and means for stopping the operation of the sewing machine when the computed seam length coincides with the data of said preset seam length.

The sewing machine may be started after a desired length for a seam in the form of a stitch series has been preset by the operator. As the sewing operation begins, the length of a seam formed by each stitch is computed from feed pitch data produced at the time. When the computed seam length coincides with the preset seam length, the operation of the sewing machine is automatically stopped.

Other and further objects of this invention will become obvious upon an understanding of the illustrative embodiments about to be described or will be indicated in the appended claims, and various advantages not referred to herein will occur to one skilled in the art upon employment of the invention in practice.

DETAILED DESCRIPTION

Figure 1:
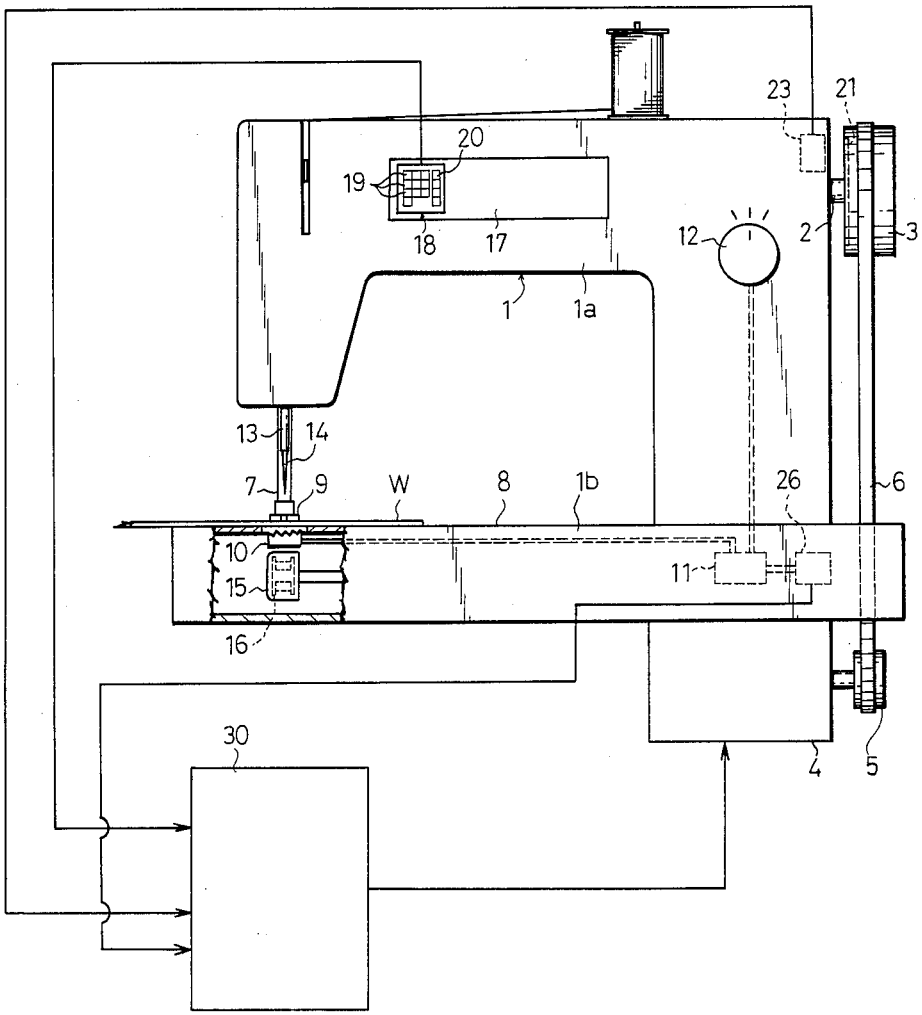
FIG. 1 is a front elevational view of a sewing machine with a control circuit added thereto, according to the present invention.

As shown in FIG. 1, a sewing machine according to the present invention has a main shaft 2 rotatably supported in an arm 1*a* of a sewing machine frame 1, with a driven pulley 3 mounted on the lefthand end (as shown) of the main shaft 2. The sewing machine frame 1 includes a bed 1*b* supporting therebeneath an electric motor 4 having a driver pulley 5 mounted on the motor output shaft. An endless belt 6 is trained around the driven and driver pulleys 3, 5. When a treadle pedal (not shown) is depressed by the sewing machine operator, the motor 4 is driven to rotate at a speed commensurate with the depth the treadle pedal is pushed down.

As the motor 4 is energized, the main shaft 2 is rotated through the driver pulley 5, the belt 6, and the driven pulley 3.

A presser bar 7 is vertically movably supported by the arm 1*a* of the sewing machine frame 1 and supports a presser foot 9 on its lower end. The presser foot 9 serves to press a work fabric W down against a work supporting surface 8 of the bed 1*b*. A feed dog 10 serving as a work feeding device is housed in the bed 1*b* and vertically movable above and below the work supporting surface 8, the feed dog 10 being positioned in vertical confronting relation to the presser foot 9. The feed dog 10 is moved in a known vertical and horizontal back-and-forth pattern in synchronism with the rotation of the main shaft 2 for coacting with the presser foot 9 to intermittently feed the work fabric W on the work supporting surface 8. A known feed adjusting device 11 serving as a feed pitch adjusting means is also housed in the bed 1*b*. The feed adjusting device 11 is operatively coupled to an adjusting knob 12 turningly movably supported on the front panel of the arm 1*a*. The feed adjusting device 11 should preferably be of the structure as disclosed in U.S. Pat. No. 3,012,531. The feed pitch at which the work fabric W can be fed by the feed dog 10 can be adjusted by turning the adjusting knob 12.

A needle bar 13 is vertically movably supported by the arm 1*a*, and a sewing needle 14 is attached to the lower end of the needle bar 13. The needle bar 13 is operatively coupled to the main shaft 2 so that the sewing needle 14 can be moved up and down across the work supporting surface 8 in synchronism with the rotation of the main shaft 2. The bed 1*b* further accommodates therein a loop taker 15 in vertical alignment with the sewing needle 14, the loop taker 15 housing a bobbin 16 rotatable relatively thereto. The sewing needle 14 and the loop taker 15 jointly constitute a stitch forming device for forming a seam of a series of lock stitches on the work fabric W on the work supporting surface 8.

A control panel 17 is mounted on the front panel of the arm 1*a*. On the control panel 17, there is disposed a seam length setting device 18 having a plurality of setting keys such as numerical keys 19 and memory keys 20. A seam to be formed on the work fabric W can be preset to a desired length prior to sewing operation by manually operating the numerical keys 19 and the memory keys 20.

Figure 2:
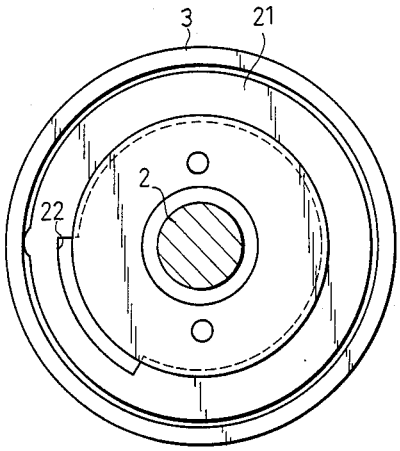
FIGS. 2 and 3 are enlarged elevational views, partly in cross section, of a reflecting plate and a needle top dead point detector, respectively, as they are in coacting positions.
Figure 3:
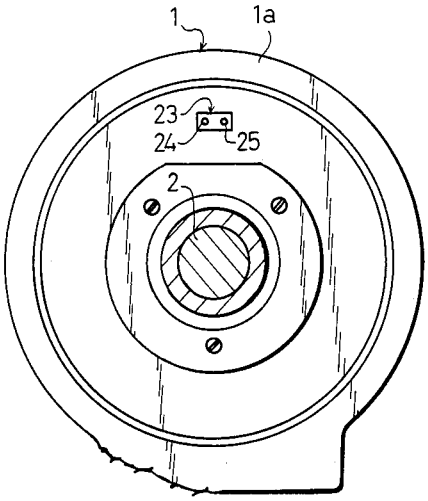

As illustrated in FIGS. 1 through 3, an annular reflecting plate 21 is attached to the inner surface of the driven pulley 3 in concentric relation to the main shaft 2, the reflecting plate 21 including an arcuate nonreflective portion 22. A needle top dead point detector 23 comprising a photoelectric sensor is mounted on the arm 1*a* in confronting relation to the reflecting plate 21. The needle top dead point detector 23 is composed of a light-emitting element 24 and a light-detecting element 25. Light emitted by the light-emitting element 24 is reflected by the reflecting plate 21 and detected by the light-detecting element 24. When the sewing needle 14 reaches its top dead point, the needle top dead point detector 23 faces the nonreflective portion 22 and generates a needle top dead point signal.

As shown in FIG. 1, the bed 1*b* houses a feed pitch data generating device 26 comprising a potentiometer (not shown) and an A/D converter (not shown) for converting an output voltage from the potentiometer to a digital signal, the potentiometer being operatively coupled to the feed adjusting device 11. The feed pitch data generating device 26 detects a work feed pitch adjusted by the feed adjusting device 11 based on the angular position in the feed adjusted device 11 and generates work feed pitch data according to the detected work feed pitch.

Figure 4:
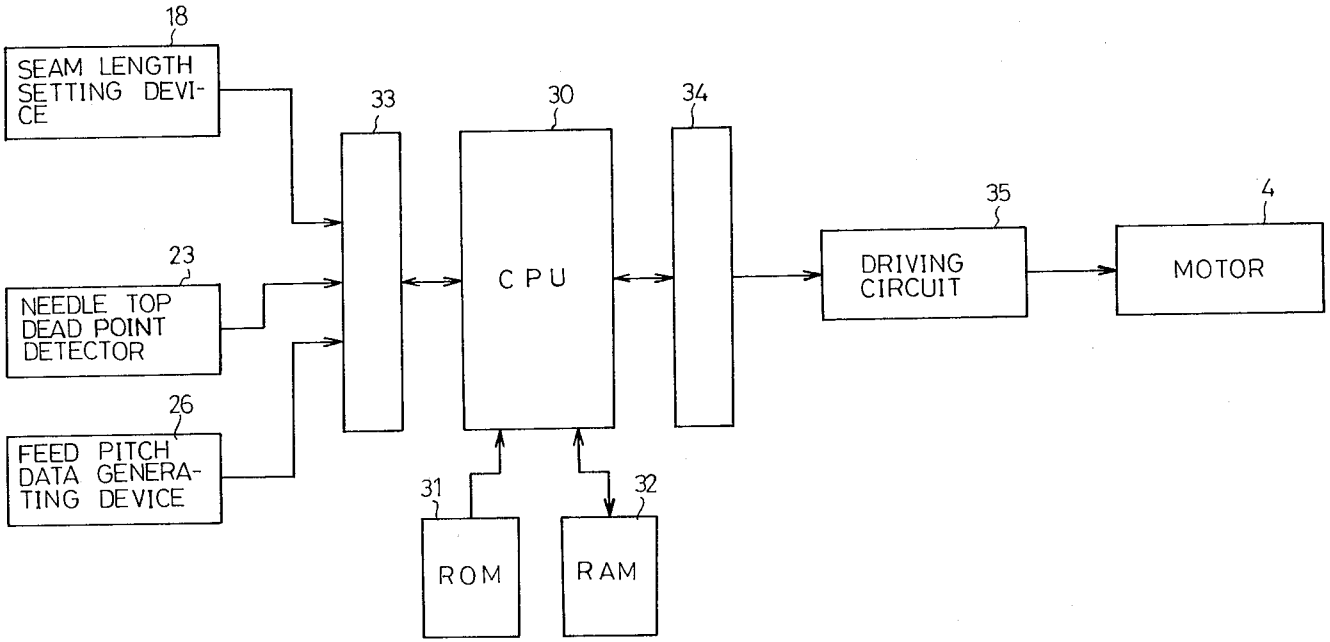
FIG. 4 is a block diagram of the control circuit.

A control circuit for controlling operation of the sewing machine will be described below with reference to FIG. 4.

The control circuit includes a central processing unit (CPU) 30 to which a read-only memory (ROM) 31 and a random access memory (RAM) 32 are connected, the ROM 31 storing a program for controlling the entire operation of the sewing machine. The CPU 30 is also coupled by an input interface 33 to the seam length setting device 18, the needle top dead point detector 23, and the feed pitch data generating device 26 for receiving setting and detected signals therefrom. The control circuit also includes a driving circuit 35 through an output interface 34, the driving circuit 35 being connected to the motor 4. When the preset seam length data is applied from the seam length setting device 18, the CPU 30 stores the preset seam length data in a setting memory in the RAM 32. As the sewing machine operates thereafter, the CPU 30 is supplied with one-stitch work feed pitch data generated by the feed pitch data generating device 26 each time a needle top dead point signal is applied from the needle top dead point detector 23. The CPU 30 computes (i.e., adds) the supplied data to determine data on the length of the formed seam. The CPU 30 then temporarily stores the computed seam length data in a temporary addition data memory in the RAM 32, compares the stored seam length data with the preset seam length data, and generates a motor de-energization signal to the driving circuit 35 if the compared data items coincide with each other.

Figure 5:
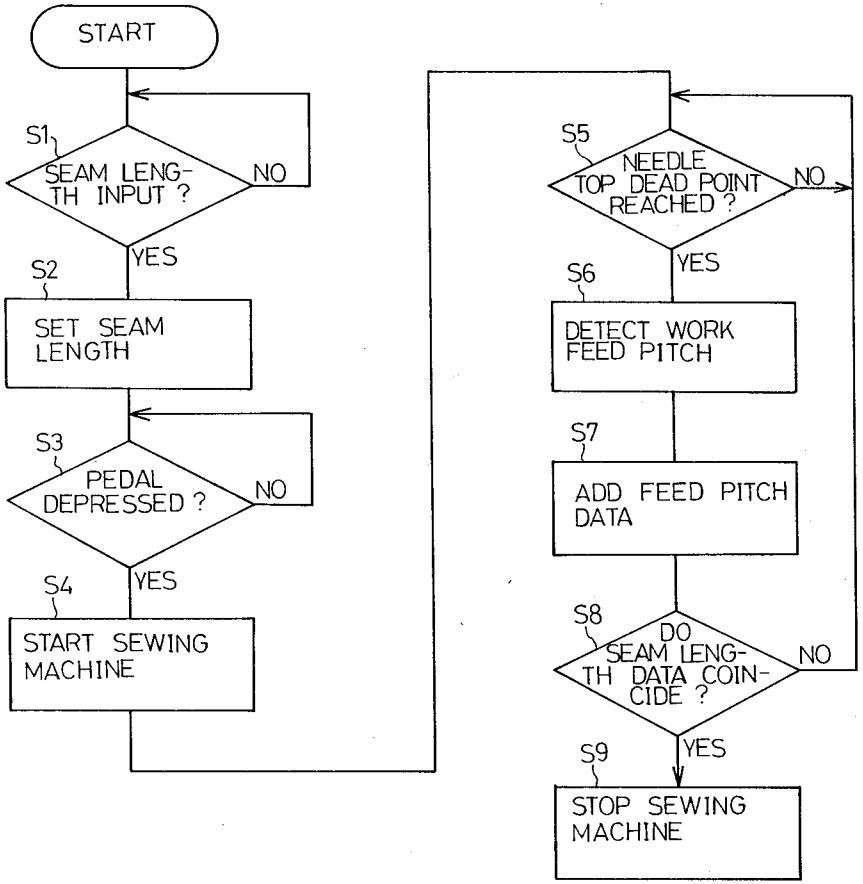
FIG. 5 is a flowchart of an operation sequence of the control circuit.

Operation of the sewing machine will hereinafter be described with reference to FIG. 5.

For sewing the work fabric W at a desired area thereof on the sewing machine, the power supply for the sewing machine is switched on. When a desired seam length to be formed on the work fabric W is input by the seam length setting device 18 in a step S1, the CPU 30 stores the input seam length data in the setting memory in the RAM 32 in a step S2. When a treadle pedal (not shown) is depressed in a step S3, the motor 4 is driven to rotate at a speed corresponding to the depth the treadle pedal is depressed. The sewing machine is now operated in a step S4 to enable the feed dog 10, the sewing needle 14, and the loop catcher 15 to cooperate in forming a seam in the form of a series of lock stitches on the work fabric W on the work supporting surface 8.

Then, the CPU 30 waits for a needle top dead point signal from the needle top dead point detector 23 in a step S5. When the main shaft 2 reaches a needle top dead point position and the needle top dead point signal is generated from the needle top dead point detector 23, the program goes to a next step S6 in which the CPU 30 is supplied with work feed pitch data corresponding to one stitch formation from the feed pitch data generating device 26. The CPU 30 adds the supplied work feed pitch data in a step S7 and temporarily stores the sum data, i.e., the formed-seam length data in the temporary memory in the RAM 32. At this time, the computed data corresponds to the length of the seam which has been formed after the initiation of the sewing operation. Thereafter, the CPU 30 compares, in a step S8, the seam length data stored in the temporary memory and the preset seam length data stored in the setting memory. If the seam length data stored in the temporary memory does not reach the preset seam length data stored in the setting memory, then the program returns to the step S5 to repeat the steps S5 through S8.

If the seam length data stored in the temporary memory coincides with the preset seam length data stored in the setting memory, then the program proceeds to a step S9 in which the CPU 30 applies a motor de-energization signal to the driving circuit 35 to stop the motor 4. Therefore, once a desired seam length is preset, the length of the formed seam remains unchanged even if the work feed pitch is varied. Even when the work feed pitch is changed by the feed adjusting device 11 while the work fabric W is being sewn, the seam of the desired length can be formed accurately on the work fabric W at its desired area. The sewing machine of the above construction can efficiently and easily be operated by the operator, and the work fabric can be handled as easily as on conventional sewing machines.

Second Embodiment

A second embodiment of the present invention will be described below. The CPU 30 stores the input seam length data in a temporary subtraction data memory in the RAM 32 in the step S2 of FIG. 5. Thereafter, the CPU 30 executes the steps S3 through S6 in the same manner as the preceding embodiment. The CPU 30 reads the seam length data from the temporary subtraction data memory in the step S7, subtracts the pitch data from the read seam length data, and stores the result of subtraction, or the difference, in the temporary subtraction data memory. Then, the CPU 30 ascertains whether the difference data newly stored in the temporary subtraction data memory has reached zero or not. If not, then the program goes back to the step 5 to repeat the subtraction process. The data stored in the temporary subtraction data memory gradually approaches zero. When the data reaches zero, the CPU 30 proceeds to the step S9 to stop the operation of the sewing machine. At this time, the seam of the preset length has been formed on the work fabric W.

Third Embodiment

Figure 6:
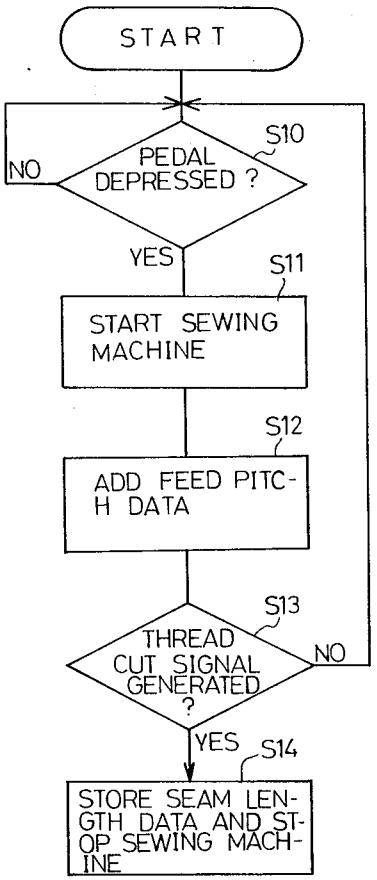
FIG. 6 is a flowchart of another operation sequence of the control circuit.

According to a third embodiment, the seam length setting device 18 used for presetting a desired seam length in the steps S1, S2 of FIG. 5 may be dispensed with, and the program may be designed as follows:

As shown in FIG. 6, the CPU 30 waits for the depression of the treadle pedal in a step S10, and starts operating the sewing machine in a step S11 when the treadle pedal is depressed, at which time the sewing machine enters a trial sewing mode. The CPU 30 is then supplied with feed pitch data each time one stitch is formed and adds the supplied feed pitch data in a step S12. Thereafter, the CPU 30 ascertains whether the sewing operation has been finished in a step S13 preferably based on a thread cut signal generated when the treadle pedal is depressed back. If no thread cut signal is produced, then the program returns to the step S10. Thus, one-stitch feed pitches data are added until the sewing operation is ended. When the desired seam length is formed and the operator finishes the sewing process, the CPU 30 stops the sewing machine in a step S14, and stores the total of the feed pitches from the starting to the end of the sewing operation as preset seam length data in the temporary memory in the RAM 32. The CPU 30 thereafter executes the steps S3 through S9 of FIG. 5 to effect the same operation as that of the previous embodimetns.

As described above, once a desired seam length has been preset, it remains the same no matter how the feed pitch may be reset or varied. There is no substantial limitation on seam lengths which may be desired to be formed. Therefore, the sewing machine of the invention can be used in various sewing applications. The operator is not interfered with in handling the work fabric since only the work presser means is positioned over the sewing machine bed.

As many apparently widely different embodiments of this invention may be made without departing from the spirit and scope thereof, it is to be understood that the invention is not limited to the specific embodiments thereof except as defined in the appended claims.

What is claimed is:

1. In a sewing machine comprising:

a stitch forming device for forming a straight seam of a series of stitches on a work fabric, said stitch forming device including a sewing needle reciprocally movable in synchronism with the rotation of a main shaft of the sewing machine;

a work feeding device including a presser foot and a feed dog for intermittently feeding the work fabric in synchronism with the rotation of the main shaft;

a feed adjusting device for adjusting the feed pitch by said feed dog; and a manual adjusting knob operatively coupled to said feed adjusting device for changing said feed pitch;

the improvement comprising:

means for generating feed pitch data corresponding to the adjusted amount of said feed adjusting device;

a keyboard arrangement having selection keys enabling the selection of a numerical value corresponding to a seam length for setting a preset seam length;

means for detecting a predetermined needle position on a reciprocal path of said sewing needle;

means for sequentially computing the total seam length based upon said feed pitch data generated by said feed pitch data generating means in response to the detection of said detection means;

means for distinguishing the coincidence between said computed total seam length and said present seam length; and means for stopping the operation of the sewing machine upon said coincidence distinguished by said distinguishing means.

2. A sewing machine according to claim 1, wherein said computing means includes means for adding the feed pitch data of all stitches formed.

3. A sewing machine according to claim 1, wherein said computing means includes means for subtracting the feed pitch data of all stitches formed from said present seam length data, and said distinguishing means distinguishes that the remainder of said subtraction reaches substantially zero.

4. A sewing machine according to claim 1, wherein said feed pitch data generating means includes a potentiometer.

* * * * *